US007388333B2

(12) United States Patent
Hildenbrand et al.

(10) Patent No.: US 7,388,333 B2
(45) Date of Patent: Jun. 17, 2008

(54) HIGH PRESSURE DISCHARGE LAMP HAVING EMISSION MATCHING AN ABSORPTION SPECTRUM OF GREEN PLANT

(75) Inventors: Volker Dirk Hildenbrand, Eindhoven (NL); Achim Gerhard Rolf Koerber, Kerkrade (NL); Antonius Cornelis Van Amstel, Eindhoven (NL); Johannes Antonius Theresia Schellen, Turnhout (BE); Marco Haverlag, Eindhoven (NL); Cornelis Sander Pot, Randwÿk (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/574,636

(22) PCT Filed: Oct. 7, 2004

(86) PCT No.: PCT/IB2004/052012

§ 371 (c)(1),
(2), (4) Date: Apr. 5, 2006

(87) PCT Pub. No.: WO2005/036585

PCT Pub. Date: Apr. 21, 2005

(65) Prior Publication Data

US 2007/0018583 A1 Jan. 25, 2007

(30) Foreign Application Priority Data

Oct. 10, 2003 (EP) ..... 03103760

(51) Int. Cl.
*H01J 17/20* (2006.01)

(52) U.S. Cl. ..... 313/641; 313/639; 313/571

(58) Field of Classification Search ..... 313/637–634, 313/570–572, 639–641, 573
See application file for complete search history.

(56) References Cited

U.S. PATENT DOCUMENTS

| | | | | |
|---|---|---|---|---|
| 3,840,767 | A * | 10/1974 | Lake | 313/639 |
| 6,147,453 | A * | 11/2000 | Geijtenbeek et al. | 313/640 |
| 6,525,476 | B1 | 2/2003 | Geijtenbeek et al. | |
| 6,841,938 | B2 * | 1/2005 | Hendricx et al. | 313/640 |
| 2001/0004191 | A1 | 6/2001 | Hendricx et al. | |

FOREIGN PATENT DOCUMENTS

| | | | |
|---|---|---|---|
| EP | 0215524 | A1 | 3/1987 |
| EP | 0587238 | A1 | 3/1994 |
| EP | 0587238 | B1 | 3/1994 |
| EP | 0896733 | A1 | 2/1999 |
| EP | 1139387 | A1 | 10/2001 |
| EP | 0896733 | B1 | 8/2007 |
| WO | 9825294 | A1 | 6/1998 |

OTHER PUBLICATIONS

J. C. Sager, et al: Light Energy Utilization Efficiency for Photosynthesis, Transaction of the ASAE, 1982, vol. 25, No. 6, pp. 1737-1746.

K. J. McCree: The Action Spectrun, Absorptance and Quantum Yield of Photosynthesis in Crop Plants, Agric. Meteorol, 1971/1972, pp. 191-216.

* cited by examiner

*Primary Examiner*—Karabi Guharay

(57) ABSTRACT

The invention relates to a high pressure discharge lamp intended for use in assimilation lighting. According to the invention the high-pressure discharge lamp has a discharge vessel, which besides a buffer gas, comprises substantially LiI as metal halide or a mixture of LiI and NaI.

5 Claims, 2 Drawing Sheets

Figure 1:
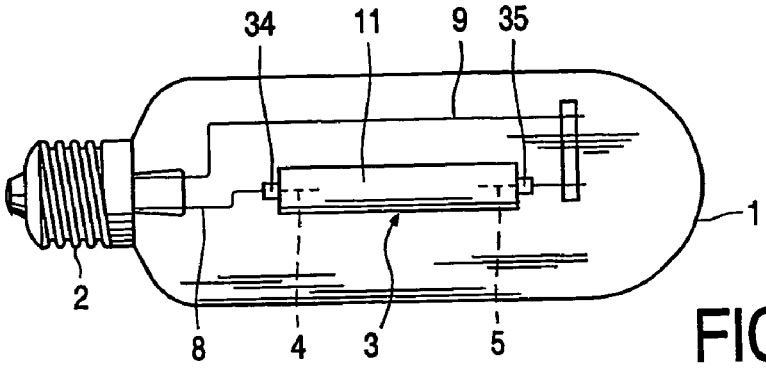

HIGH PRESSURE DISCHARGE LAMP HAVING EMISSION MATCHING AN ABSORPTION SPECTRUM OF GREEN PLANT

The invention relates to a high-pressure discharge lamp, which is in particular suited for use in plant growing irradiation.

The absorption of green leaves is strongest in the blue and the red part of the spectrum. Photons (quanta) between 400 and 700 nm are determining the rate of photosynthesis. As absorption of these photons is the driving force for photosynthesis, a spectral quantum yield of photosynthesis has been derived by MCree (The action spectrum, absorptance and quantum yield of photosynthesis in crop plants, Agric. Meteorol. 1971/1972, 9.191-216) and refined by Sager et al. (Light Energy Utilization Efficiency for Photosynthesis, Transactions of the ASAE, General Edition, 1982, 25/6, 1737-1746). These studies learn that the yield of photosynthesis is high over a large region having relative maxima in the blue and the red part of the spectrum. High intensity discharge lamps with Na or NaI efficiently emit radiation in particular in the region of the NaD-line at 589 nm, where the absorption of the chlorophyll is strong. Particularly, high-pressure sodium (called SON or alternatively HPS) lamps are therefore presently used for assimilation lighting in green houses. SON lamps reach luminous efficacies between 100 and 150 lm/W and photon flux sensitivity up to 1.9 μmol/(Ws). High intensity discharge lamps with comparable luminous efficacies are lamps on the basis of NaI and $CeI_3$ fillings. In EP 0 896 733 a metal-halide system with NaI and $CeI_3$ is described, which can reach efficacies between 130 and 174 lm/W. The luminous efficacy decreases when Li is added. In U.S. Pat No. 6,147,453 a lamp with NaI, $CeI_3$, and LiI filling is described, which only reaches luminous efficacies between 100 and 135 lm/W.

For an efficient support of plant growth, lamps must generate light very efficiently in the region where the photosynthetic yield is maximal.

The main drawback of the known lamp with the filling comprising the combination of NaI, $CeI_3$, and LiI is that it emits a considerable amount of light in the green region of the spectrum, where the photosynthetic yield is lowest Although it has a high luminous efficacy, it is less suitable for stimulation of plant growth than lamps on the basis of Na or NaI, which emit more efficiently in the red part of the spectrum. Both the lamp with a filling comprising NaI/$CeI_3$ and the one comprising Na, Ce and Li halides have the drawback of being susceptible to demixing phenomena of the filling during lamp operation.

The main disadvantage of SON lamps is that they emit mainly around 589 nm although the plants still absorb photons very efficiently up to approximately 700 nm. The conversion of electrical power into photons of SON lamps is therefore not optimal with respect to the plant absorption spectrum.

In literature a lamp for promoting plant growth is proposed having a ceramic discharge vessel comprising Hg, LiI in an amount of between 0.02 to 4.2 mg/cm$^3$, and an excess of Li to compensate for effects of corrosion. Due to the relative large amount of Hg the spectrum of the lamp has a relative large quantity of the emitted light in the green part of the spectrum. This is a drawback as it is not really effective in plant growth.

According to the invention the high-pressure discharge lamp has a discharge vessel, which besides a buffer gas comprises an excess amount of substantially LiI as metal halide or of a mixture of LiI and NaI, the lamp having a coldest spot temperature $T_{cs}$ during normal operation of at least 1200K. Normal operation of the lamp is understood in this respect stable operation at a lowest power and on a corresponding voltage for which the lamp is designed. As buffer gas Hg is frequently used. Besides the discharge vessel may comprise a rare gas like Ar, Kr and Xe or a mixture of thereof, which promotes starting and can also have a buffer gas capacity. In particular Xe also has a buffer gas capacity with increased fill pressures. The discharge vessel can be made of ceramic or made of quartz or quartz glass. Ceramic is meant in this respect to be translucent mono or densely sintered poly crystalline metal oxide, like $Al_2O_3$, $Y_2O_3$, $Y_3Al_5O_{12}$ (YAG) and densely sintered metal nitride, like AlN. A 150 W LiI-lamp according to the invention with mercury as buffer gas and a ceramic alumina discharge vessel, for instance, emits 15-20% of its radiation in the blue region between 400 and 500 nm and about 75% in the red region between 600 and 700 nm, which are surprisingly high percentages. The emission of the lamp thus matches the absorption spectrum of green plants surprisingly very well, which match is much better than that of a high-pressure sodium lamp, where only up to 10% is emitted in the blue region and at most about 40% in the red region. The high percentage of blue light was in itself unexpected because the main lines of Li are at 611 and 671 nm, respectively. A further surprising advantage of the lamp according to the invention is that no traces of serious corrosion are recorded.

A coldest spot temperature $T_{cs}$ below 1200K results in partial vapour pressures of Li becoming so low that the percentage in the blue region strongly reduces and consequently the radiation contribution of the Hg gets more important The latter however results in an increasing part of the radiation being emitted in the green part of the spectrum, which is however ineffective with regard to plant growth.

Whereas the use of LiI as a filling component generally means a reduction of the luminous efficacy (see above), it surprisingly turns out that the energy conversion of a lamp according to the invention is at least comparable or even better than that of a comparable known lamp. For a 150W lamp with a filling comprising Na or NaI the energy conversion efficacy is about 27%, which value increases to almost 30% for the invented 150 W lamp described above. This increase is surprising and unexpected. Despite the higher blue fraction of the Li spectrum, the photon flux per input power (in μmol/(W*s)) of the invented lamp turned out to be even 10% higher than is the case with the comparable lamp having a filling of Na or NaI.

The new lamp therefore provides a higher energy and higher photon efficiency as well as a spectrum, which is better adapted to the plant absorption and photosynthetic quantum yield.

Figure 2:
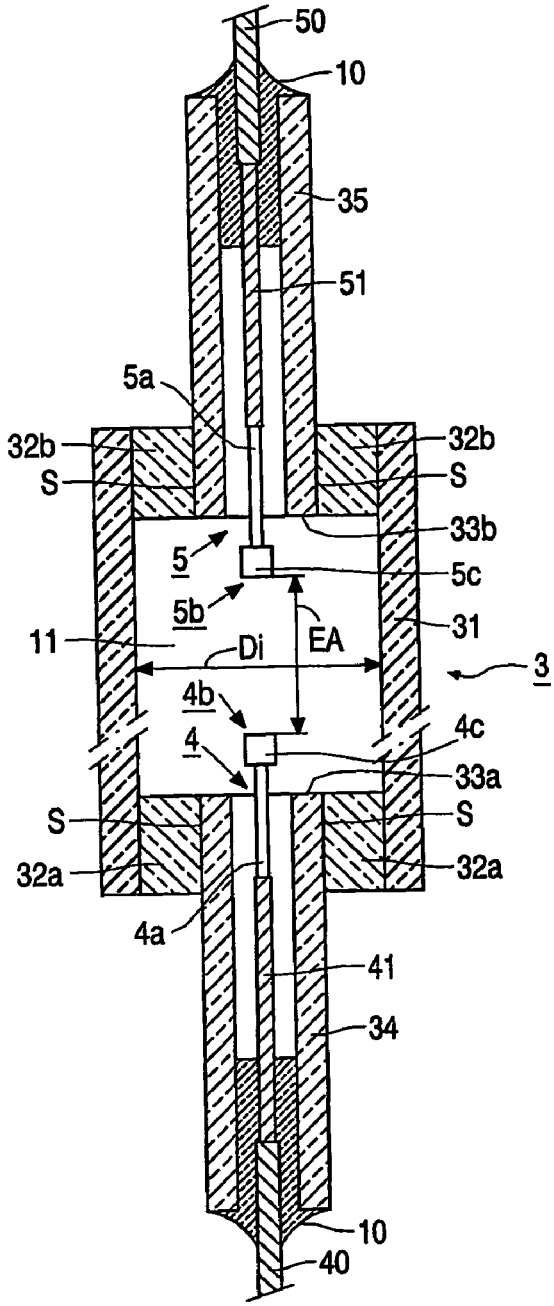
Figure 3:
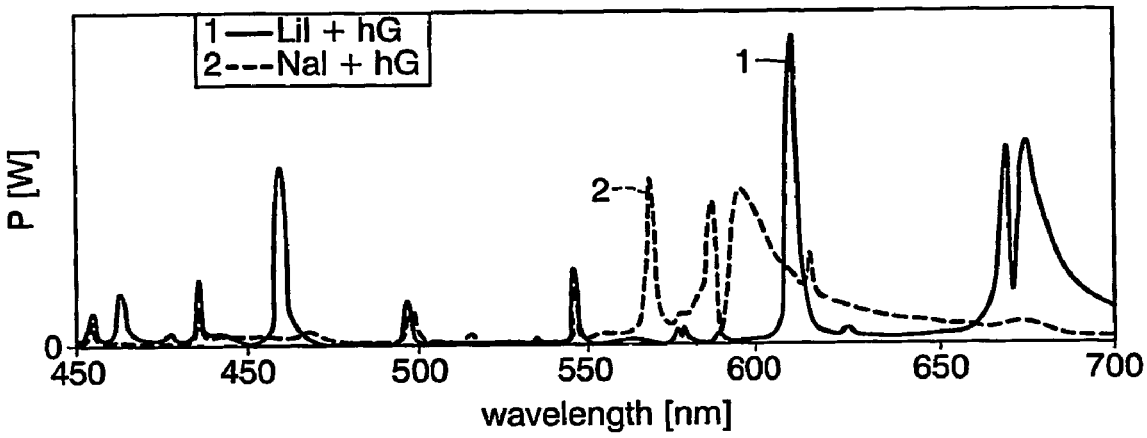

The above and further aspects of the invention will be explained in more detail below with reference to a drawing, in which:

FIG. 1 schematically shows a lamp according to the invention,

FIG. 2 shows in detail the discharge vessel of the lamp in accordance with FIG. 1, and FIG. 3 shows a spectrum of a lamp according to the invention compared with a non-invented lamp.

FIG. 1 shows a discharge lamp according to the invention having a ceramic wall. FIG. 1 shows a metal halide lamp provided with a discharge vessel 3 having a ceramic wall, which encloses a discharge space 11 containing an ionizable filling. Two electrodes whose tips are at a mutual distance EA are arranged in the discharge space, and the discharge vessel has an internal diameter Di at least over the distance EA. The discharge vessel is closed at one side by means of a ceramic projecting plug 34, 35 which encloses a current lead-through conductor (FIG. 2: 40, 41, 50, 51) to an electrode 4, 5 positioned in the discharge vessel with a narrow intervening space and is connected to this conductor in a gastight manner by means of a melting-ceramic joint (FIG. 2: 10) at an end remote from the discharge space. The discharge vessel is surrounded by an outer bulb 1, which is provided with a lamp cap 2 at one end. A discharge will extend between the electrodes 4, 5 when the lamp is operating. The electrode 4 is connected to a first electrical contact forming part of the lamp cap 2 via a current conductor 8. The electrode 5 is connected to a second electrical contact forming part of the lamp cap 2 via a current conductor 9. The discharge vessel, shown in more detail in FIG. 2 (not true to scale), has a ceramic wall and is formed from a cylindrical part with an internal diameter Di which is bounded at either end by a respective end wall portion 32*a*, 32*b*, each end wall portion 32*a*, 32*b* forming an end surface 33*a*, 33*b* of the discharge space. The end wall portions each have an opening in which a ceramic projecting plug 34, 35 is fastened in a gastight manner in the end wall portion 32*a*, 32*b* by means of a sintered joint S. The ceramic projecting plugs 34, 35 each narrowly enclose a current lead-through conductor 40, 41, 50, 51 of a relevant electrode 4, 5 having a tip 4*b*, 5*b*. The current lead-through conductor is connected to the ceramic projecting plug 34, 35 in a gastight manner by means of a melting-ceramic joint 10 at the side remote from the discharge space. The electrode tips 4*b*, 5*b* are arranged at a mutual distance EA. The current lead-through conductors each comprise a halide-resistant portion 41, 51, for example in the form of a Mo—$Al_2O_3$ cermet and a portion 40, 50 which is fastened to a respective end plug 34, 35 in a gastight manner by means of the melting-ceramic joint 10. The melting-ceramic joint extends over some distance, for example approximately 1 mm, over the Mo cermet 40, 41. It is possible for the parts 41, 51 to be formed in an alternative manner instead of from a Mo—$Al_2O_3$ cermet. Other possible constructions are known, for example, from EP-0 587 238. A particularly suitable construction was found to be a halide-resistant coil applied around a pin of the same material. Mo is very suitable for use as a highly halide-resistant material. The parts 40, 50 are made from a metal whose coefficient of expansion corresponds very well to that of the end plugs. Nb, for example, is for this purpose a highly suitable material. The parts 40, 50 are connected to the current conductors 8, 9 in a manner not shown in any detail. The lead-through construction described renders it possible to operate the lamp in any burning position as desired.

Each of the electrodes 4, 5 comprises an electrode rod 4*a*, 5*a* which is provided with a coiling 4*c*, 5*c* near the tip 4*b*, 5*b*. The projecting ceramic plugs are fastened in the end wall portions 32*a* and 32*b* in a gastight manner by means of a sintered joint S.

In a practical embodiment the ceramic wall is made from alumina and the thus formed discharge vessel has a diameter of 4 mm and a length of 36 mm. In FIG. 3 the spectrum of a lamp, of which the metal halide filling substantially comprises an excess amount of 8 mg LiI is shown with curve 1. Of a comparable non-invented lamp, which filling comprises NaI instead of LiI the spectrum is shown with curve 2. In both lamps the filling of the discharge vessel also comprises 3.8 mg Hg as buffer gas and 300 mbar Ar/Kr. The lamp according to the invention has a coldest spot temperature $T_{cs}$ during normal operation of 1376K. The coldest stop temperature $T_{cs}$ was directly measured by means of an infrared camera The spectrum of the non-invented lamp is equivalent to the spectrum of an ordinary HSP lamp. From the shown spectra it is clear that the blue fraction in the spectrum 1 of the LiI comprising lamp is much higher than in the HPS spectrum 2. It is also clearly shown that the spectrum 1 emits much more radiation in the region from 600 to 700 nm than the spectrum 2. A further advantage of the lamp according to the invention is that its visible lumens are more than a factor 2 lower than in case of a HPS or of a NaI comprising lamp of comparable wattage. Thus lighting for plant growing, so called assimilation lighting, results in less illumination of the surroundings.

The invented lamp described above is used in assimilation lighting in green houses. In an experiment the effect on tomato plants, chrysanthemum plants and potted roses is investigated. In a first area plants were illuminated with lamps according to the invention having a total flux input per unit area of 118 μmol/s. As comparison in a second area plants were illuminated with an HSP lamp having a total flux output of 122 μmol/s. After an illumination period of only 18 hours there was an equal or even a slightly better growing of the plants in the first area, in particular with respect to the tomato plants. As the photon efficiency of a lamp comprising the filling of LiI is about 15% higher than the photon efficiency of a comparable HPS lamp, the assimilation lighting through the invented lamp requires less nominal lamp power for achieving equal growing results.

Comparison of some lamp characteristics of a lamp according to the invention with lamps not according to the invention is given below.

The lamp according to the invention has a filling of 3.8 mg Hg and LiI. The lamp has a nominal power of 150W. The photon flux per unit power of this lamp is 1.5 μmol/(W*s).

For a comparable lamp in which the halide is NaI the photon flux per unit power is 1.35 μmol/(W*s).

A HPS lamp with a nominal power of 150W has a photon flux per unit power of 1.29 μmol/(W*s).

Copies of the lamp according the invention have been operated for 5000 hours without showing any serious corrosion.

The invention claimed is:

1. A high-pressure discharge lamp having a discharge vessel with a diameter on the order of 4 mm and a length on the order of 36 mm and with an onisable filling comprising a buffer gas of 3.8 mg Hg and an excess amount of a metal halide, which is substantially formed by 8 mg LiI, the 8 mg LiI enabling the lamp to emit 15-20% of its radiation as blue light with a wavelength between 400 and 500 nm and on the order of 75% of its radiation as red light with a wavelength between 600 and 700 nm, the lamp emission matching an absorption spectrum of green plants, the lamp further having a coldest spot temperature $T_{cs}$ during normal operation of at least 1200K.

2. A lamp according to claim 1 wherein the excess amount of the metal halide is substantially a mixture of LiI and NaI.

3. A lamp according to claim 2 wherein the onisable filling comprises substantially equal amounts of LiI and NaI.

4. A lamp according to claim 1 wherein the buffer gas also comprises Xe.

5. A lamp according to claim 1 wherein the discharge vessel is made of ceramic.

* * * * *